United States Patent [19]

Amado, Jr.

[11] 4,121,528

[45] Oct. 24, 1978

[54] METHOD OF CONSTRUCTION OF A CONTAINER WITH INTEGRAL VALVE BOSS

[76] Inventor: Juan Jose Amado, Jr., Aptdo. 4241, Panama 5, Panama

[21] Appl. No.: 764,951

[22] Filed: Feb. 2, 1977

Related U.S. Application Data

[62] Division of Ser. No. 405,853, Oct. 11, 1973, abandoned.

[51] Int. Cl.[2] ..... B21D 51/24

[52] U.S. Cl. ..... 113/120 S; 113/116 W

[58] Field of Search ..... 113/120 S, 120 H, 120 R, 113/120 L, 116 QA, 116 DD; 72/334, 348; 220/3, 5, 85 F, 85 P

[56] References Cited

U.S. PATENT DOCUMENTS

| | | | |
|---|---|---|---|
| 1,699,361 | 1/1929 | Karmazin | 72/334 |
| 2,945,294 | 7/1960 | Courtot et al. | 220/85 P |
| 3,481,175 | 12/1969 | White | 72/348 |
| 3,844,355 | 10/1974 | Kreipe et al. | 220/3 |

*Primary Examiner*—Michael J. Keenan

[57] ABSTRACT

A container for a pressurized gas cylinder provided with an integral non-protruding boss for a valve and method of making same. The container is made from substantially similar half shell portions each of which has a substantially straight cylindrical body wall portion and a dome-shaped end portion. Preferably the upper shell portion is flanged and inverted with respect to the bottom shell whereby the shells may be welded along a substantially horizontally extending weld line. Prior to be welded to the bottom shell, the upper shell is formed with an outwardly extending bulge which is reversely bent in order to form an integral, non-protruding boss. After being reversely bent, the bulge is reshaped to deepen the budge thereby diminishing its size. It is then pierced and internally threaded to receive a valve member.

3 Claims, 7 Drawing Figures

METHOD OF CONSTRUCTION OF A CONTAINER WITH INTEGRAL VALVE BOSS

This is a division, of application Ser. No. 405,853 filed Oct. 11, 1973, now abandoned.

This invention relates to a container for a pressurized gas cylinder and method of making same and, more particularly, to such a container having an integral, non-protruding valve boss.

Heretofore it has been known to manufacture containers for compressed or liquefied gases from steel. One such container is illustrated and described in U.S. Pat. No. 3,152,718, issued on Oct. 13, 1964, to Albert J. Weatherhead, Jr. Containers such as this while representing an improvement in the art still require a substantial amount of welding which is difficult to perform while maintaining a leakproof container and still preserving first strength and other properties necessary to pass safety tests. Thus in the aforementioned patent, three critical and substantial welds must be effected one for the side seam, one to attach to the top cap structure, and one to attach to the bottom cap structure.

In accordance with the present invention, the welding is reduced to a single weld line around the central girth of the container by manufacturing the body of the container from aluminum or aluminum alloy material which permits the container to be formed from two substantially similar deep drawn half shells. Although the aluminum-containing material permits the container body to be formed from a softer, more ductile, material than steel, a sufficient amount of work hardening is introduced during the deep drawing operation to permit the aluminum material to pass all required safety tests.

As an additional feature of the present invention, the container is formed with an integral, non-protruding boss to which a valve is secured for dispensing liquefied petroleum gas or the like. The integral, non-protruding boss is produced by forming an outwardly extending bulge in the center of a dome-shaped end of one of the half shell containers, reversely bending the outwardly extending bulge to extend entirely within the dome-shaped shell section, reshaping the reversely bent bulge to deepen it and diminish its diametral size, piercing and reversely bending the bulge and internally threading it to produce a boss which is substantially flush with the arcuate or dome-shaped end of the container.

Two substantially similar half shells are welded together in opposed relationship to form the container body. Thereafter, a bottom stand or pedestal is supplied to the container and handle means attached to the top of the container with the handle means also serving as a guard for a valve which may be threadedly secured to the integral, non-protruding boss.

The inherent advantages and improvements of the present invention will become more readily apparent upon considering the following detailed description of the invention and by reference to the drawings in which.

Figure 1:
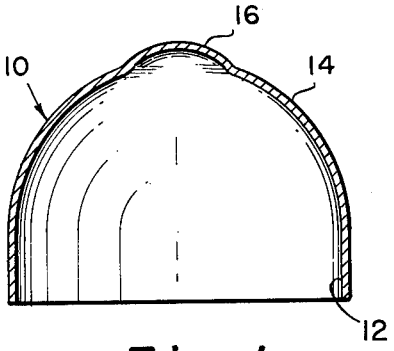
FIG. 1 is an elevational view taken in vertical cross section illustrating the formation of one-half container portion in accordance with one step of this invention.

Referring now more particularly to the drawings, FIG. 1 illustrates a half shell or half container indicated generally at 10 which has been deep drawn from a flat, circular blank so as to produce a half container or shell 10 having a substantially straight cylindrical wall portion 12 and a generally arcuate or dome-shaped top. The container 10 which is to provide the upper half of the finished container is provided with an outwardly extending bulge 16 which provides sufficient aluminum material to form an integral, non-protruding boss. The container is preferably drawn from aluminum alloys 5154 or 5454 as designated by the Aluminum Association and substantial work hardening is applied to these blanks during their formation.

Figure 2:
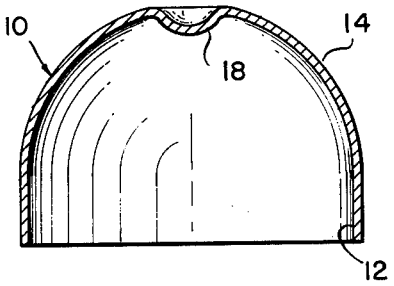
FIG. 2 is an elevational view taken in vertical cross section illustrating the half container portion of FIG. 1 after a subsequent step.
Figure 3:
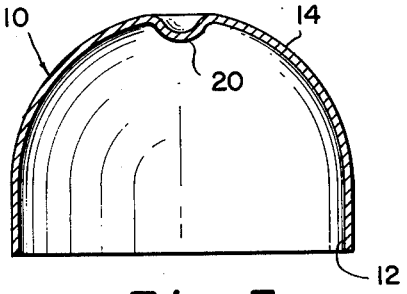
FIG. 3 is an elevational view taken in vertical cross section illustrating the half container portion of FIG. 2 after a subsequent step.
Figure 4:
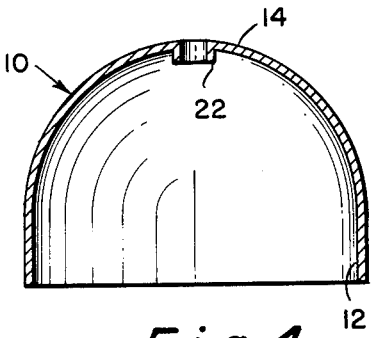
FIG. 4 is an elevational view taken in vertical cross section illustrating the half container portion of FIG. 3 after a subsequent step.

FIG. 2 illustrates the next step in the method of forming the container wherein the half shell or half container 10 has had the outwardly extending bulge reversely bent forming reversely bent bulge 18. In the next step of the method, this reversely bent bulge 18 is shaped by being drawn deeper 20 thereby diminishing the size of diameter of the bulged portion.

Figure 5:
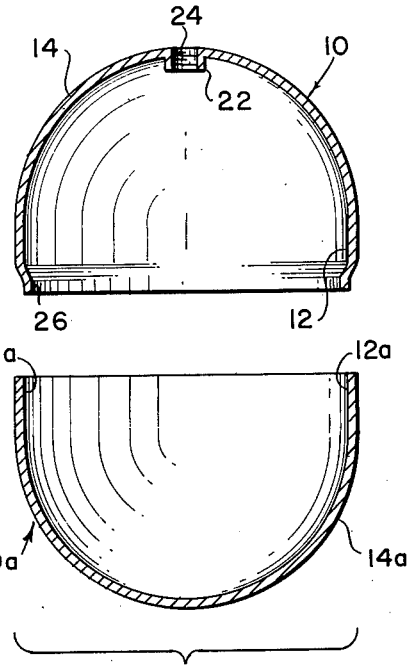
FIG. 5 is an elevational view taken in vertical cross section illustrating an upper half container and a lower half container immediately prior to being welded.

In the next step of the method, the reshaped and reversely bent bulge portion is pierced to form boss structure 22 the outer surface of which is substantially flush with the arcuate or dome-shaped end 14 of the container 10. The work piece or half container 10 is in condition to be internally threaded as is illustrated at 24 in FIG. 5. Also shown in this figure is an additional method step wherein the lower marginal edge of the cylindrical body wall portion of the container has been provided with an inwardly and downwardly extending flange 26 whereby the upper half shell or container 10 will nest when inverted within a substantially similar half shell portion or half container **10*a* which is also illustrated to have a straight cylindrical wall portion 12*a* and an arcuate or dome-shaped bottom 14*a*. The marginal edge portion 26*a* of the bottom half container 10*a* is not altered in its configuration so as to overlap the inwardly and downwardly extending flange 26 of the top half container 10. Thus it will be seen that containers 10 and 10*a* are substantially similar in shape differing only in the provision of a boss structure to receive a dispensing valve and a flange to facilitate welding with each variant being introduced into the upper half container 10**.

Figure 6:
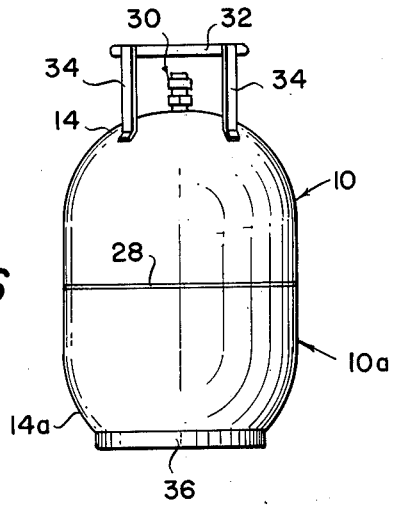
FIG. 6 is an elevational view illustrating a finished container.

All of the above greatly facilitates the welding of the two half shells or half containers together as is illustrated by substantially horizontally extending weld line 28 in FIG. 6. In this figure, a valve which is used to dispense the contents of the container is indicated generally at 32. A suitable handle means is also illustrated in FIG. 6 which consists of a handle portion 32 may be made conveniently from a bent tube supported above the top of the container and above the top of the valve 30 by suitable bracket members 34. FIG. 6 also illustrates the provision of a suitable stand or pedestal 36 for the bottom half container **10*a*. In an actual container, stand 36 consists of a piece of tubing bent into circular shape and welded exteriorly to the exterior surface of the dome-shaped bottom 14***a*. Other stands or pedestals may be used.

Figure 7:
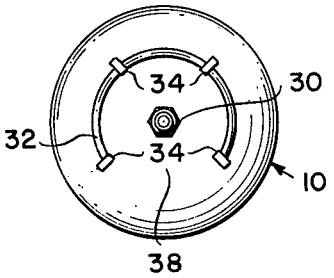
FIG. 7 is a top plan view of the finished container of FIG. 6.

As illustrated in FIG. 7, the tubular member which forms handle 32 is illustrated to extend circumferentially through more than 180° but less than 360° in order to permit ready access to the valve member 30 in the assembly and disassembly thereof from the container 10.

The container described may contain bottled butane, propane or L.P.G. gas and is preferably made from high strength aluminum alloys 5454 or 5154 and will withstand working pressures of 240 psig according to the ASME Code. A typical container has the capacity for thirty pounds of propane or seven gallons of propane which is capable of holding 61.4 pounds of water. The container itself is surprisingly light and weighs 11 pounds. Further typical dimensions include a dimension of 17 inches from the top of the container 10 to the bottom of the container 10*a* exclusive of the stand 36 and of the handle means at the top of container 10. The overall height from the bottom of base or pedestal 36 to the top of handle means 32 is typically 21½ inches. The diameter of the base or pedestal 36 preferably formed from tubular material is 8 inches. The diameter of the formed half sections is typically 10 inches and the diameter across the handle 30 is typically 8¼ inches. The above dimensions are given for purposes of illustration and are in no way restrictive of the invention.

While a presently preferred embodiment of the invention has been illustrated and described, it will be recognized that the invention may be otherwise variously embodied and practiced within the scope of the claims which follow.

What is claimed is:

1. A method of forming a container for a pressurized gas cylinder which comprises the steps of (a) forming a pair of substantially similar half containers by a deep drawing operation from a substantially circular blank so that each of said half containers has a substantially straight cylindrical body wall portion and an outwardly extending dome-shaped end portion, (b) subsequently forming an integral, non-protruding boss on one of said half containers by the steps of (1) forming an outwardly extending bulge in the center of the outwardly extending dome-shaped end thereof, (2) reversely bending said outwardly extending bulge to extend entirely within said dome-shaped end, (3) reshaping said reversely bent bulge to deepen it and diminish its size, (4) piercing said reversely bent bulge and internally threading said bulge, (c) and securing said pair of half containers together by means of welding to provide a hollow container having a horizontally extending circumferential weld.

2. A method of forming a container for a pressurized gas cylinder as defined in claim 1 including the step of forming said container from aluminum-containing material which is capable of having a substantial amount of cold working imparted therto.

3. A method of forming a container for a pressurized gas cylinder as defined in claim 1 including the step of interfitting the bottom edge of the substantially straight cylindrical body wall portion of the upper half container within the substantially straight cylindrical body wall portion of the lower half container prior to said welding step by deforming the lower marginal edge of said cylindrical body wall portion of the upper half container to provide an inwardly and downwardly extending flange.

* * * * *